United States Patent [19]

Klimek et al.

[11] 4,225,251

[45] Sep. 30, 1980

[54] ELECTRO-MECHANICAL PRINTING APPARATUS

[75] Inventors: Norbert M. Klimek, Cockfosters; Manfred A. Huber, New Barnet, both of England

[73] Assignee: The Rank Organisation Limited, London, England

[21] Appl. No.: 2,213

[22] Filed: Jan. 9, 1979

[30] Foreign Application Priority Data

Jan. 9, 1978 [GB] United Kingdom ..... 638/78

[51] Int. Cl.[3] ..... B41J 3/05

[52] U.S. Cl. ..... 400/124; 400/320; 400/702; 400/582

[58] Field of Search ..... 400/119, 124, 320, 702, 400/702.1, 582, 583, 583.1, 583.2, 583.4; 101/93.04

[56] References Cited

U.S. PATENT DOCUMENTS

| | | | |
|---|---|---|---|
| 450,473 | 4/1891 | Northrop | 400/702 |
| 1,694,923 | 12/1928 | Kurowski | 400/702 |
| 3,656,041 | 4/1972 | Bonzano | 400/583.2 X |
| 3,888,340 | 6/1975 | Hoffman | 400/583.2 X |
| 3,891,077 | 6/1975 | Sauerbrunn | 400/124 |
| 3,942,619 | 3/1976 | Nordstrom et al. | 400/119 |
| 4,024,941 | 5/1977 | Sekikawa et al. | 400/124 |
| 4,030,588 | 6/1977 | Hanagata et al. | 400/320 X |
| 4,034,842 | 7/1977 | Giacone | 400/124 X |
| 4,075,636 | 2/1978 | Galetto et al. | 400/124 X |
| 4,169,683 | 10/1979 | Bernardis et al. | 400/124 |

*Primary Examiner*—E. H. Eickholt

*Attorney, Agent, or Firm*—Brisebois & Kruger

[57] ABSTRACT

A portable electro-mechanical printer has a platen (1) over which electro-sensitive paper is advanced, relative to a print head (6) having a few row of selectively energizable needles (8) which is movable by an electric motor transmission (18,19,21,24) parallel to the platen in a scanning direction transverse the row of needles. A timing disc (25) is driven by the drive transmission, the disc being subdivided into sectors and cooperating with two relatively displaced photocells (26,27) which produce two periodic signals upon rotation of the disc, these signals being utilized to provide clock pulses controlling successive energizations of the print head needles as the latter is scanned across the paper.

2 Claims, 6 Drawing Figures

STATE CHANGING LOGIC
FOR.
REV.
A
B
30μs
MONOSTABLE
43
40μs
MONOSTABLE
41
42
$A_{CL}$
$B_{CL}$
BISTABLE
39
-VeE
+VeE
38
BISTABLE
40
36
51
37
52
VREF
25
26
27
51
52
FOR= $A_{CL}\cdot+VeE.\bar{S}_2+A_{CL}\cdot-VeE.S_2+B_{CL}\cdot+VeE.S_1+B_{CL}\cdot-VeE.\bar{S}_1$
REV.= $A_{CL}\cdot+VeE.S_2+A_{CL}\cdot-VeE.\bar{S}_2+B_{CL}\cdot+VeE.\bar{S}_1+B_{CL}\cdot-VeE.S_1$
A
B

ELECTRO-MECHANICAL PRINTING APPARATUS

This invention relates to printing apparatus, more specifically printing apparatus in which information, in the form of characters or a plot, is printed on electro-sensitive paper by means of a print head having needles which can be energised selectively with a potential sufficient to make a mark on the paper.

It is known in such an electro-mechanical printer to provide a print head with a row of needles the tips of which are arranged close to or in contact with the surface of electro-sensitive paper to be printed. The electro-sensitive paper is usually made up of three layers comprising a base layer of ordinary paper, a central layer of pigment and a top surface layer of thinly evaporated aluminium. Such paper has the same handling texture as ordinary paper, but is much stronger mechanically. An image can be 'printed' on the paper by subjecting the surface layer of aluminium to a localised potential sufficient to evaporate the aluminium and expose the underlying black pigment layer. In the case of a matrix printer having a print head consisting of a row of needles, the selective application to any one needle of a print potential will result in the formation of a black dot on the paper surface underlying the energised needle as a result of the localised evaporation of the aluminium surface layer. Typically, the print potential required to expose such a black dot would be about 30 volts, which is well within the recognised safety standards for contact with the human body. Such a printer is well suited for use as a portable printing machine for operation by electrical signals, for example, radio signals or locally generated command signals. Since printing does not rely upon mechanical impact such an electro-mechanical printer is relatively silent in operation and long-wearing.

In an electro-mechanical printer of the above described type the print head is employed to print a matrix of dots on the surface of the electro-sensitive paper by scanning the print head across the surface of the paper in a direction generally transverse the direction of the rwo of needles and energising selected needles in the head at successive positions of the head. After each such scan of the print head the paper is advanced and a further scan is made by the head. For the printing of alpha-numeric characters the needles would be energised selectively to build up the desired characters from columns of dots, each scan of the head resulting in a line of characters, while for the printing of a diagrammatic or pictorial plot the needles of the head would be energised selectively according to the plot to be printed, the plot resulting from a number of consecutive line scans of the head. In either printing mode it is essential that the position of each column of dots produced by the head at each print position along the line scanned by the head be precisely determined, and furthermore the successive line scan of the head must also be synchronized accurately with the preceeding lines, particularly when a graphic plot is being printed. In order to achieve the necessary precision of the print head scanning it has been normal practice in electro-mechanical printers of this type to employ high precision stepping motors or the like to effect the scanning movement of the print head and the feed of the paper relative to the print head.

An object of the present invention is to provide an improved electro-mechanical printing apparatus capable of achieving the necessary high precision for matrix printing at relatively low cost.

According to the present invention there is provided an electro-mechanical printing apparatus having a platen over which electro-sensitive paper is advanced, a print head cooperating with the platen, the print head having a number of selectively energisable needles arranged in a row, an electric motor coupled through a drive transmission to the print head to effect translational movement by the latter parallel to the platen in a direction transverse the row of needles, a timing disc coupled to the drive transmission to be rotated thereby, the disc being subdivided into sectors of different light-transmitting or reflecting characteristics and cooperating with photoelectric sensing means which produce periodic signals upon rotation of the disc, and clock pulse generating means responsive to the periodic signals produced by the sensing means to provide clock pulses which are utilised to control successive energisations of the print head as the latter is displaced relative to the paper.

By coupling the timing disc to the drive transmission of the print head a precise relationship is established between the position of the print head and the clock pulses derived from the photoelectric sensing means. The clock pulses can therefore be used to give precise control of the successive energisations of the print head as the latter scans across the paper. The sectors of the timing disc and its speed of rotation are preferably such that the resulting clock pulses coincide with the instants of successive energisations of the print head, thereby determining the "pitch" interval between successive columns of dots printed on the paper upon successive energisations of the print head needles. The photoelectric control of the print head through direct coupling to the drive transmission of the print head itself avoids difficulties which would otherwise be caused by lost motion in the print head drive or variations in the speed of the drive motor. Since the precision of the print head control is dependent upon the photoelectric sensing means and the disc with which it cooperates the need to provide an expensive high precision stepping motor or the like as the drive motor for the print head is avoided, and the electric motor may in practice be a relatively less expensive direct current motor of high quality.

In a preferred embodiment of the invention the timing disc is provided with a number of alternate white (or clear) and black segments of equal width and is formed integrally with a shaft or hub forming part of the drive transmission. Preferably the photoelectric sensing means comprise two photocells displaced relatively to each other in the direction of rotation of the timing disc so that the signals produced by the two photocells upon rotation of the disc are in phase quadrature relative to each other, the clock pulse generating means combining the two photocell output signals and deriving therefrom clock pulses which are phase-displaced relative to each other for opposite directions of rotation of the timing disc, and therefore, opposite directions of movement of the print head. The dual photocell arrangement results in a train of clock pulses for either direction of movement of the print head, that is, either direction of rotation of the drive motor, the pulses corresponding to forward movement being phase-displaced relative to the pulses corresponding to reverse movement of the head.

In a preferred practical embodiment of the invention the drive transmission includes a pulley which drives a timing belt or chain connected to a carriage upon which the print head is supported, the carriage cooperating with a linear guide extending parallel to the platen and transverse the direction of the row of needles carried by the print head. Preferably the pulley drives a toothed flexible timing belt which ensures positional rigidity of the drive transmission and accurate displacement of the print head carriage without slippage, even if the apparatus is subjected to horizontal acceleration forces, as may be the case in a portable apparatus installed, for example, in a vehicle.

A light obturator member or flag may be arranged for movement with the print head, the flag cooperating with photoelectric detectors arranged at opposite ends of the permitted range of travel of the print head so as to provide signals which halt or reverse the movement of the print head.

The needle print head is preferably supported upon a carriage which is pivotally mounted about an axis parallel to the platen and transverse the row of needles, the carriage being slidable along a guide, and being urged by biassing means about the said axis of in a sense to move the print head away from the paper, and including a solenoid which when energised acts upon the carriage in opposition to the biassing means to maintain the needles of the print head in an operative printing position relative to the platen.

A needle-cleaning brush or pad may be fixed in a position to be engaged by the tips of the needles of the print head when the latter is at one end of its travel relative to the platen. By this means it is arranged that the tips of the needles, which come into light contact with the surface of the paper, are cleaned of debris or dust at the end of each complete scan of the print head.

The paper may be advanced over the platen by a sprocket wheel or friction driven through a speed reducing drive transmission or by a second electric motor. The two electric motors of the apparatus are preferably direct current motors with skew windings and iron-less rotors: such motors have low moment of inertia and a long working life.

The speed reducing drive transmission connected to the second motor may include a shaft carrying a further timing disc, the latter cooperating with photoelectric detector means arranged to provide signals representative of advance of the paper by the drive sprocket, for controlling line shift movements of the paper between successive scans of the print head.

The invention will be further described, by way of example, with reference to the accompanying diagrammatic drawings, in which.

The illustrated embodiment of the invention is an electro-mechanical printer designed for application where medium speed data throughput, silent operation and low power consumption are the prime requirements. The apparatus is intended to be portable and may, for example, be installed in a vehicle or associated with portable logging equipment or mobile instrumentation.

Figure 4:
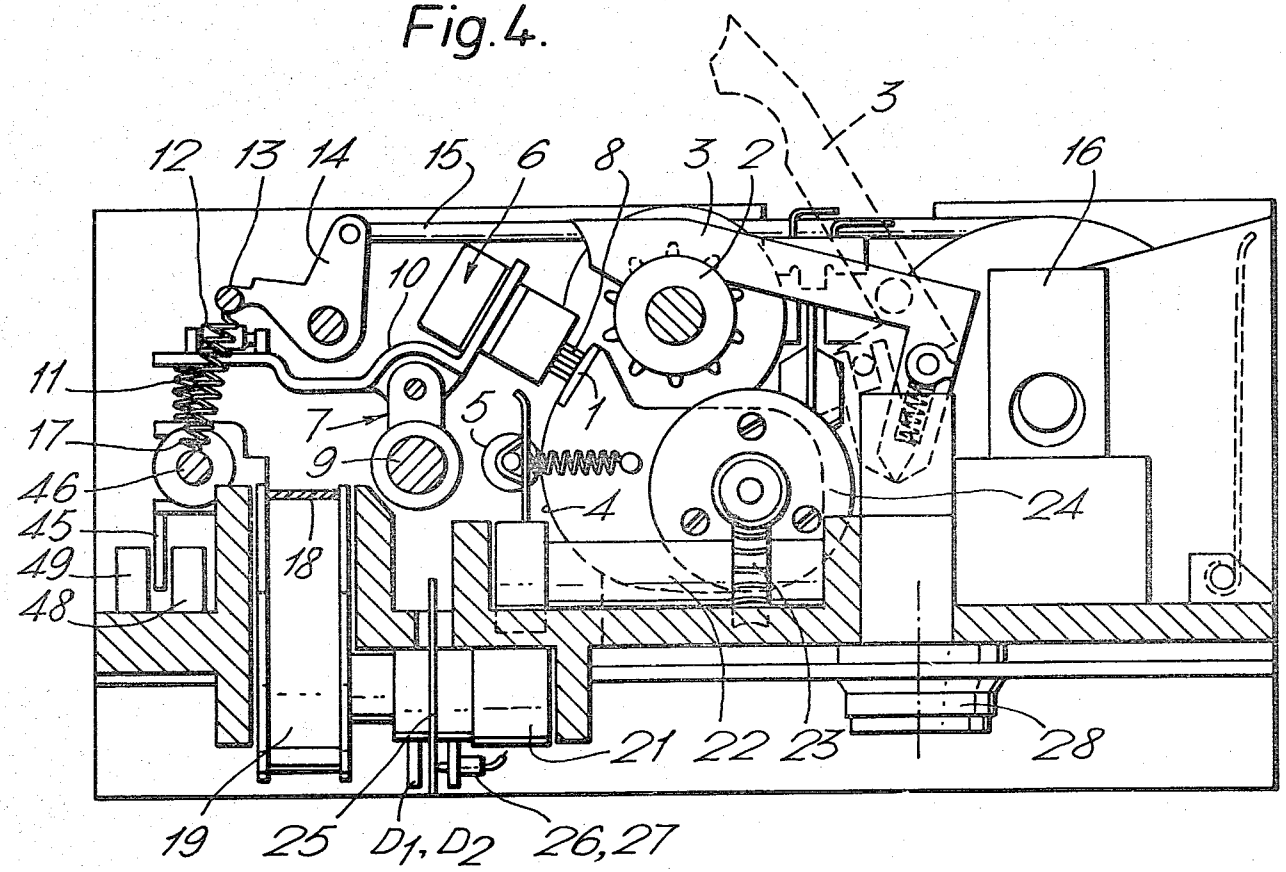
FIG. 4 is a diagrammatic cross section taken on line IV—IV of FIG. 1.

The apparatus includes a flat, rubber coated platen bar 1 over which an electro-sensitive paper is advanced from a tally roll (not shown) stored in the housing of the apparatus, the advance of the paper being controlled by a sprocket roller 2 which engages holes punched in one or both margins of the web of paper withdrawn from the tally roll. A pivoted clamp 3 is movable from an open position, shown in broken outline in FIG. 4, into a closed position, shown in full outline, in which it clamps the paper in positive engagement with the sprocket roller 2. The paper web is guided on to the platen bar 1 by passing over a curved plastics paper guide 4, the paper web being maintained firmly in contact with the paper guide 4 by a spring-loaded electrically conductive contact roller 5.

The paper web fed over the platen bar 1 consists of an electro-sensitive three-layer sandwich formed by a base layer of ordinary paper, an intermediate pigment layer, and a top surface layer of thinly evaporated aluminium. Electrical contact is made with the aluminium surface layer by the contact roller 5, which is earthed, upstream of the platen bar 1.

A print head 6 cooperates with the palten bar 1. The print head 6 is removably mounted on a carriage 7 which is displaceable in a direction transverse the direction of paper feed over the platen bar 1, parallel to the surface of the platen bar 1, that is, perpendicular to the plane of FIG. 4. The print head has a row of parallel needles 8 supported rigidly in epoxy resin encapsulation, the row of parallel needles being arranged in a plane parallel to the direction of paper advance over the platen bar 1, and the needles 8 themselves being perpendicular to the surface of the flat platen bar 1. In the operative, printing, position of the print head 6 the tips of the needles 8, which are disposed in a common plane, are close to the surface of the platen bar 1 so that the needles 8 are lightly in contact with the surface of the paper on the platen bar 1.

In the illustrated embodiment of the invention the needle head 6 has nine needles 8 having a diameter of 0.3 mm spaced apart regularly at inter-axis intervals of 0.4 mm. The paper contact ends of the needles 8 are flat and coplanar, and ground so as to avoid sharp edges. The other ends of the needles 8 are connected to individual conductors of a flexible printed circuit ribbon (not shown) by means of which the individual needles are connected to respective electrical output terminals N1 . . . N9 of an electronic control circuit of the printing apparatus, shown schematically in FIG. 6.

The application of a print potential, in this example 30 volts, to any selected needle 8 of the print head results in the evaporation of the aluminium surface layer of the paper immediately beneath the flat tip of the needle, so that a black dot is effectively "printed" on the paper by an impact-less process.

The print head carriage 7 is slidable along a straight guide rod 9 extending parallel to the platen bar 1 in a direction transverse the row of needles 8 so that the print head 6 can effect linear scanning movements across the width of the paper supported on the platen bar 1. The print head carriage 7 includes a yoke 10 pivoted about a transverse axis parallel to the axis of the guide rod 9. One arm of the yoke 10 supports the print head 6 while another arm of the yoke 10 is engaged by a helical compression spring 11 which urges the yoke 10 about its pivot axis, biassing the print head 6 towards the platen bar 1. This latter arm of the yoke 10 carries a roller 12 arranged with its axis perpendicular to the pivot axis of the yoke 10. A tilt bar 13 extends parallel to the guide rod 9 and cooperates with the roller 12. The tilt bar 13 is carried by one arm of a bellcrank lever 14 the other arm of which is connected by way of a push rod 15 to a rotary solenoid 16. When the solenoid 16 is de-energised the tilt bar 13 is held in engagement with the roller 12 by helical tension springs 17, holding the yoke 10 in a position which tilts the print head 6 away from the platen bar 1. When the solenoid 16 is energised the tilt bar 13 is lifted away from the roller 12, allowing the compression spring 11 to bias the print head 6 into an operative, printing, position in which the tips of the needles 8 are in contact with the paper on the platen bar 1.

Scanning movement of the print head 6 relative to the platen bar 1 along the guide rod 9 is effected with precise control by means of a toothed flexible timing belt 18 rigidly connected to the print head carriage 7 and extending across the full width of the platen bar 1. The timing belt 18 passes over a drive pulley 19 and tension pulley 20, the drive pulley 19 being mounted on a shaft which is driven by means of spur gearing 21. The spur gearing 21 and the drive pulley 19 form part of a drive transmission, the spur gearing 21 in turn being driven by a shaft 22 which is connected through a speed reducing worm and wheel drive 23 to a carriage drive electric motor 24. The drive transmission between the motor 24 and the print head carriage 7 is substantially free of backlash or lost motion. The motor 24 is a high quality direct current motor with skew windings and an ironless rotor, the motor being reversible so as to drive the print head carriage in a forward or reverse scanning direction at a substantially uniform speed.

Figure 5:
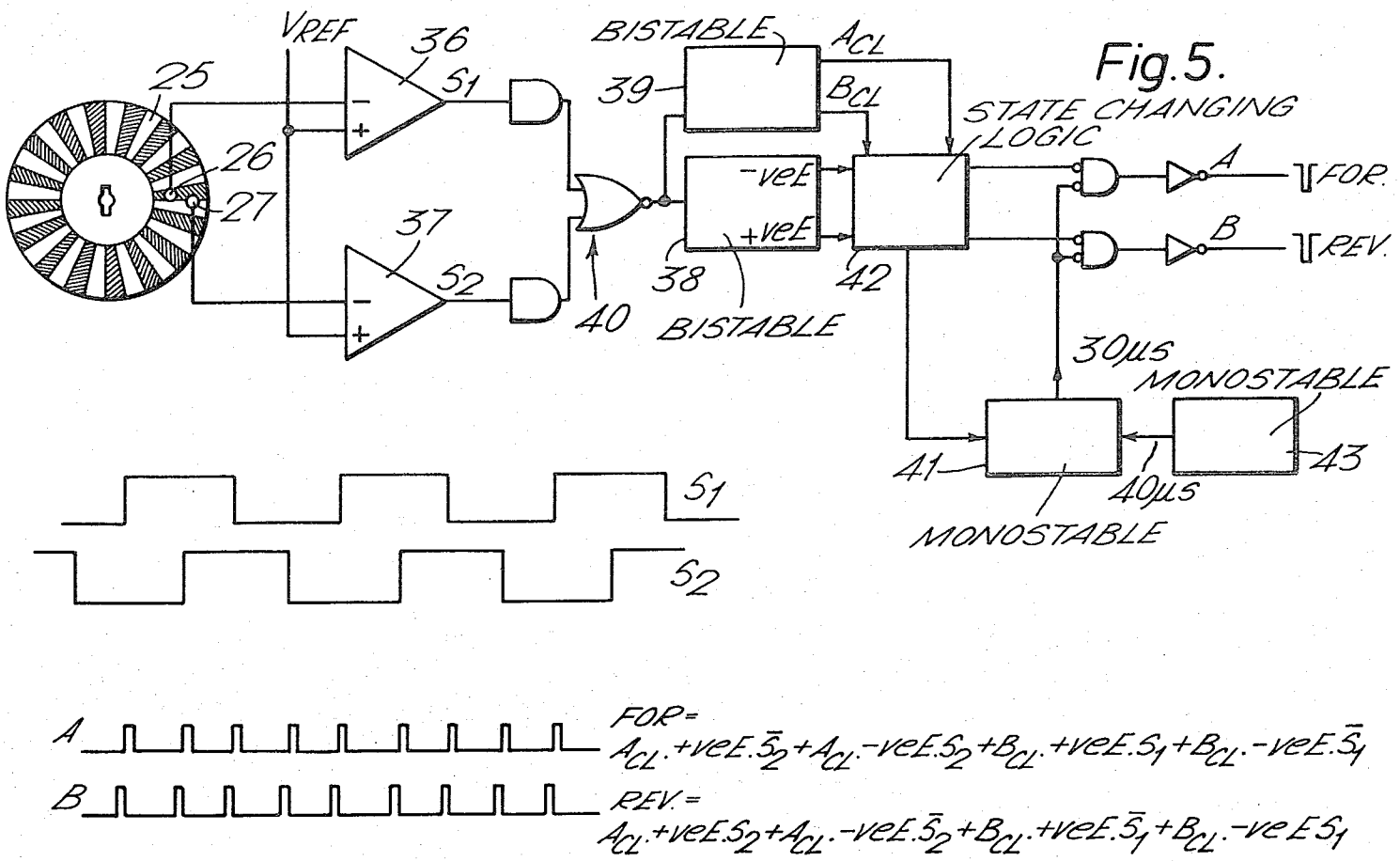
FIG. 5 illustrates schematically the circuit arrangement associated with the timing disc of the apparatus shown in FIGS. 1 to 4.

A "mylar" timing disc 25 is rigidly coupled to the shaft on which the drive pulley 19 is mounted. The timing disc is subdivided into a number of equal alternating clear (or white) and black segments. Two photocells 26, 27, operate with the disc 25 and are arranged to receive light which has been transmitted through or reflected from the disc. The photocells 26, 27, are arranged on different radial lines with respect to the axis of rotation of the disc 25, the angular separation between these radial lines being one half of the angular width of one of the disc segments, so that the electrical signals provided by the photocells 26,27, upon rotation of the disc are phase quadrature relative to each other, as illustrated in FIG. 5.

Between successive scans of the print head 6 across the paper supported on the platen bar 1 the paper is advanced by rotation of the sprocket roller 2 to position the paper for a subsequent scan of the print head 6. Such line shift movements are effected by a second electric motor 28, also a direct current motor, coupled to the sprocket roller 2 through two worm and wheel speed reduction units 29, 30 interconnected by a shaft 31. A further timing disc 32 is fixed on the shaft 31, and may in fact be moulded integrally with the shaft 31. The disc 32 is slotted and cooperates with a photocell 34 which receives light from a light emitting diode 35 through the slotted disc 32, the output pulses from the photocell 34 being utilised to control the line shift incremental movements produced by the motor 28.

The two photocells 26, 27 associated with the sectored timing disc 25 produce respective electrical square wave outputs $S_1$, $S_2$ (FIG. 5) which are in phase quadrature by virtue of the relative angular offset between the two photocells, referred to above. The two photocells 26, 27 may be arranged on the same side of the disc 25, as illustrated diagrammatically in FIG. 5, so as to receive light from respective light-emitting diodes $D_1$, $D_2$ disposed on the other side of the timing disc 25 and aligned with the respective photocells. Such an arrangement is applicable to the case where the timing disc has alternate clear and black sectors.

The two phase quadrature square wave outputs $S_1$, $S_2$ from the two photocells 26, 27 are applied to respective voltage comparators 36, 37, in which each signal is compared with a reference voltage $V_{ref}$ to produce accurately predetermined square wave outputs by a Schmitt trigger action, the effect of the voltage comparators being to shape the photocell outputs and discriminate these outputs from background noise. The two square wave outputs from the comparators 36, 37, are combined and applied to two bistable circuits 38, 39 which effectively "remember" the last voltage transistion on the square wave $S_1$ or $S_2$, resulting in four output states which are passed through decoding logic 40 in which the four output states are combined according to the boolean expressions shown in FIG. 5. A monostable circuit 41 generates 30 microsecond output pulses and is triggered by state-change sensing logic 42 which responds to the edges of the two square waves $S_1$, $S_2$ derived from the comparators 36, 37. For a direction of rotation of the disc 25 corresponding to forward movement of the print head carriage 7 the 30 microsecond output pulses of the monostable 41 are applied to one output A while for rotation of the timing disc 25 in the opposite direction corresponding to reverse carriage movement the 30 microsecond pulses are applied to a second output B. Thus clock pulses will appear on either output A or output B according to the direction of carriage movement the "forward" clock pulses FOR on output A being phase-displaced by one pulse width relative to the reverse clock pulses REV on output B as shown in FIG. 5.

A second monostable 43 generates 40 microsecond blanking pulses which are utilised to disable the monostable 41 during each 30 microsecond pulse produced thereby. The train of clock pulses FOR or REV are utilised to control the successive energisations of the selected needles of the print head 8 as the latter is scanned across the paper, at successive positions or pitch intervals at which columns of dots are printed on the paper. One clock pulse corresponds to a column position and the leading edge of each clock pulse, which is negative-going, is utilised to initiate each column print.

Figure 6:
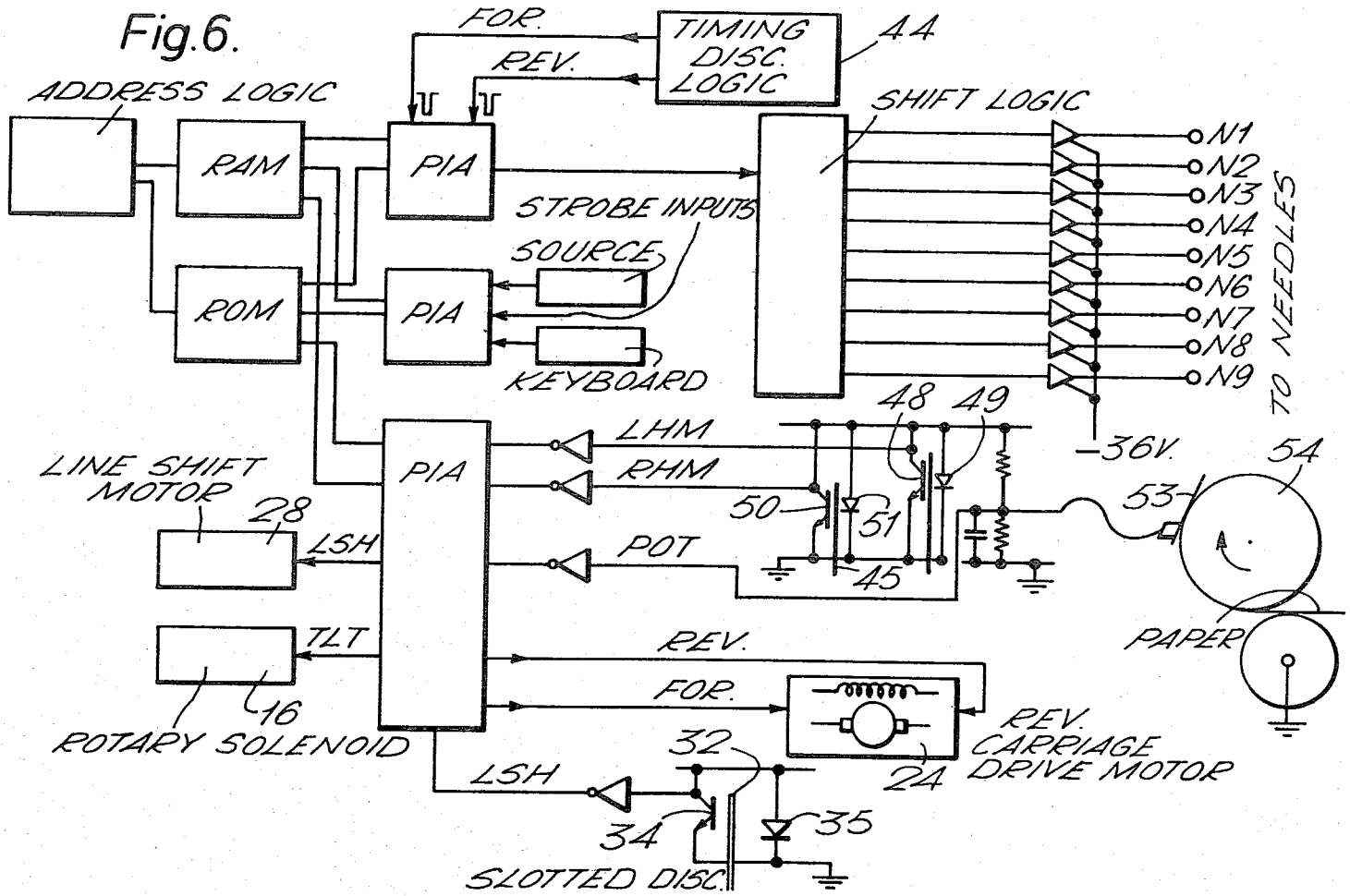
FIG. 6 is a schematic diagram illustrating the basic element of the electronic circuit of the apparatus shown in FIGS. 1 to 4.

The electronic control system of the printing apparatus is illustrated schematically in FIG. 6. The clock pulse generating logic associated with the timing disc 25 and described with reference to FIG. 5 is indicated by 44 in FIG. 6. The clock pulses FOR or REV are utilised to initiate the application to selected needle outputs N1 . . . N9 connected to the print head needles of a 36 volt potential at instants in the scanning movement of the print head determined by the clock pulses. The selected needles to be energised at each column position along a line being scanned by the print head are determined by plot input signals PLT in the case of a plotting mode of operation where the printer produces a matrix of dots to reproduce a graphic or pictorial print, or alternatively by character column codes stored in a read only memory ROM and extracted from the latter by address logic. For the printing of each alpha-numeric character there will correspond a succession of character column codes, each column being composed of a row of dots produced by the selective energisation of the print head needles so as to result in the formation of a given character. For each character, therefore, there will be a code representing the successive character column codes to be extracted from the ROM. The codes for each character are stored in a random access memory RAM which can be addressed either by keyboard input signals or by input signals derived from source equipment such as, for example, a radio receiver. Programmable interface adaptors are indicated diagrammatically by PIA in FIG. 6.

The slotted rotary disc 32 driven by the line shift motor 28 causes the associated photocell 34 to produce pulses LSH which are utilised to control the operation of the line shift drive motor 28. Two different line shift incremental movements of the motor 28 result according to whether the apparatus is used for alpha-numeric printing or for plotting. In the case of alpha-numeric printing the line shift increment produced by the motor 28 will be such as to leave a gap between successive lines printed by the print head, while for use of the apparatus in the plotting mode a smaller line shift would be employed so as to leave no gap between successive lines of printed dots. In the illustrated embodiment the timing disc 32 which controls the line shift motor 28 has two slots displaced relative to each other by 180°.

Pivotal movement of the print head 6 into engagement with the paper on the platen bar 1 is effected by energisation of the rotary solenoid 16 which, as described above, acts upon the pivotal yoke 10 of the print head carriage 7 through the rod 15 and lever 14. The rotary solenoid 16 is energised by a signal TLT generated automatically whenever the bi-directional print head carriage motor 24 is engaged into forward drive by the signals FOR. When the direction of movement of the print head carriage 7 is reversed, or when the carriage is halted at the end of a forward line scan the rotary solenoid 16 is de-energised allowing the print head 6 to be pivoted under the action of the spring 11 out of engagement with the paper on the platen bar 1.

A rectangular flat flag 45 of opaque plastics material is attached to the print head carriage 7 and guided for movement in the line scanning direction along a guide rod 46 extending parallel to the guide rod 9. The flag 45 has a rectangular notch 47 near its left hand edge as viewed in FIG. 1, the flag 45 cooperating with a photocell 48 arranged in an adjustable position near the left hand end of the carriage guide rod 46 to define a left hand margin for the printing produced by the print head 6. The photocell 48 is illuminated by a light emitting diode 49. The flag 45 first interrupts the beam between the light emitting diode 49 and the photocell 48 by its leading (left hand) edge when the print head carriage is moving towards the left, a second beam interruption occurring shortly afterwards when the right hand edge of the notch 47 interrupts the beam. The signal provided by the photocell 48 upon the first interruption is utilised to energise the rotary solenoid 16, bringing the print head 6 into printing engagement with the paper, and the second interruption results in a left hand margin signal LHM which is utilised to start a line of printing by commencing the generation of the forward carriage drive pulses FOR.

Figure 1:
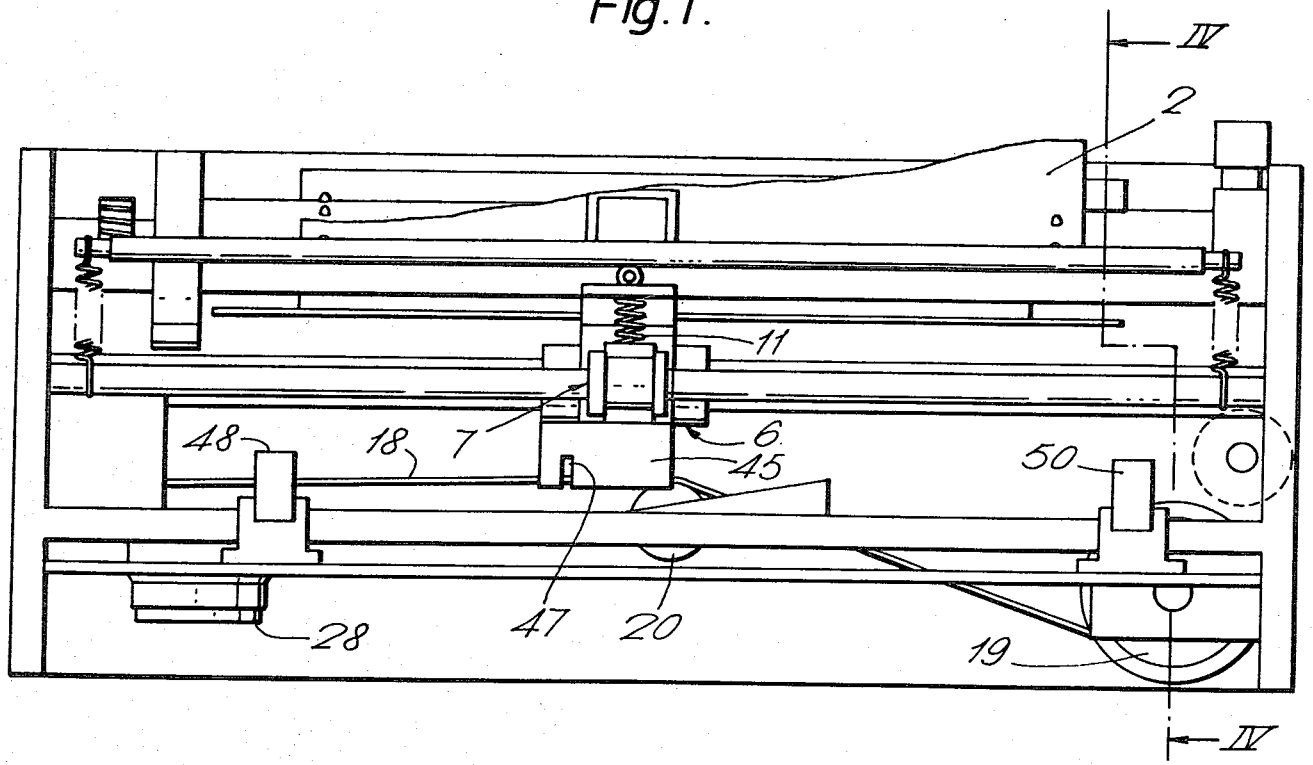
FIG. 1 is a front elevational view of a portable electro-mechanical printing apparatus according to one embodiment of the invention.
Figure 2:
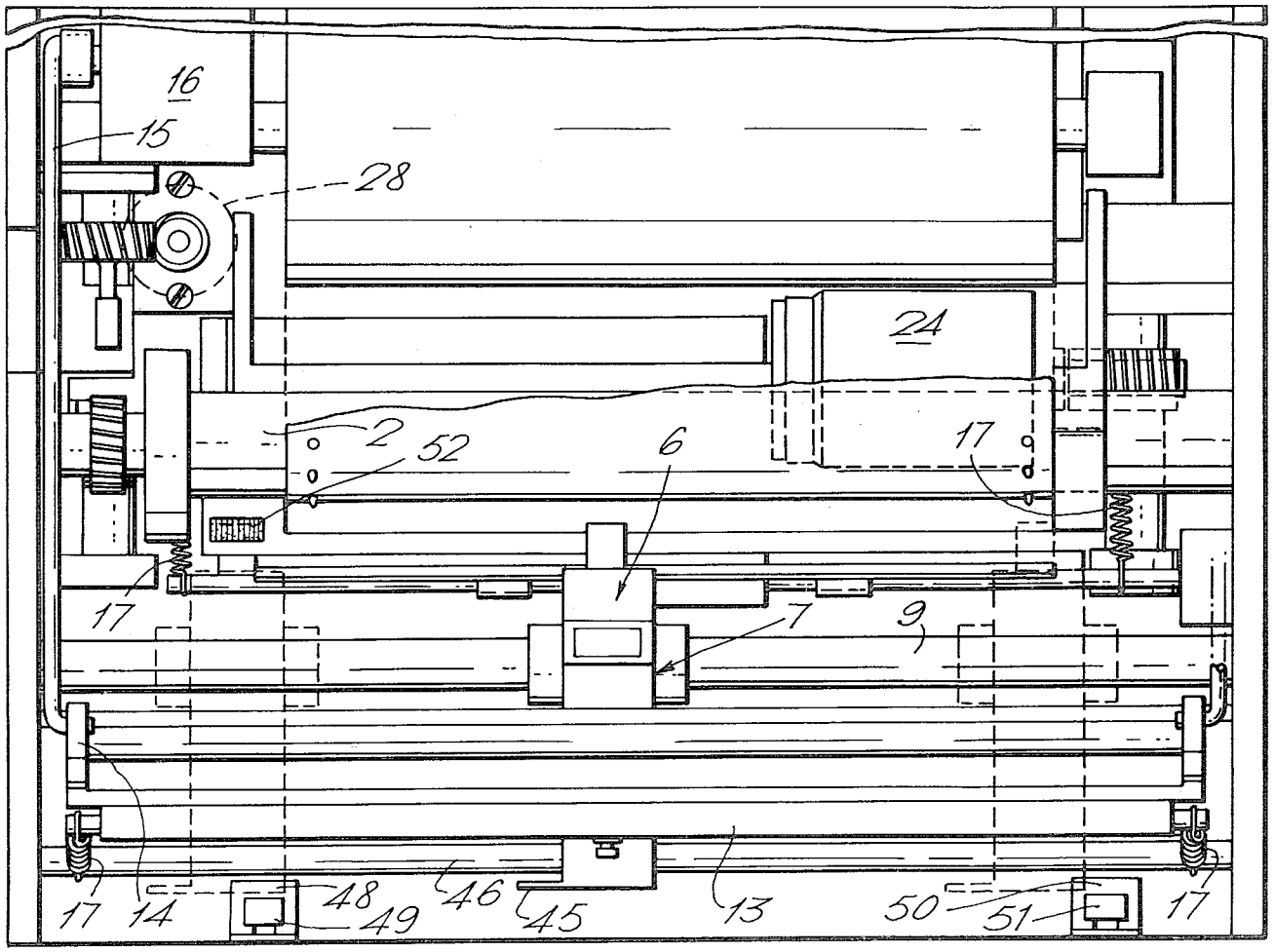
FIG. 2 is a plan view of the apparatus shown in FIG. 1.
Figure 3:
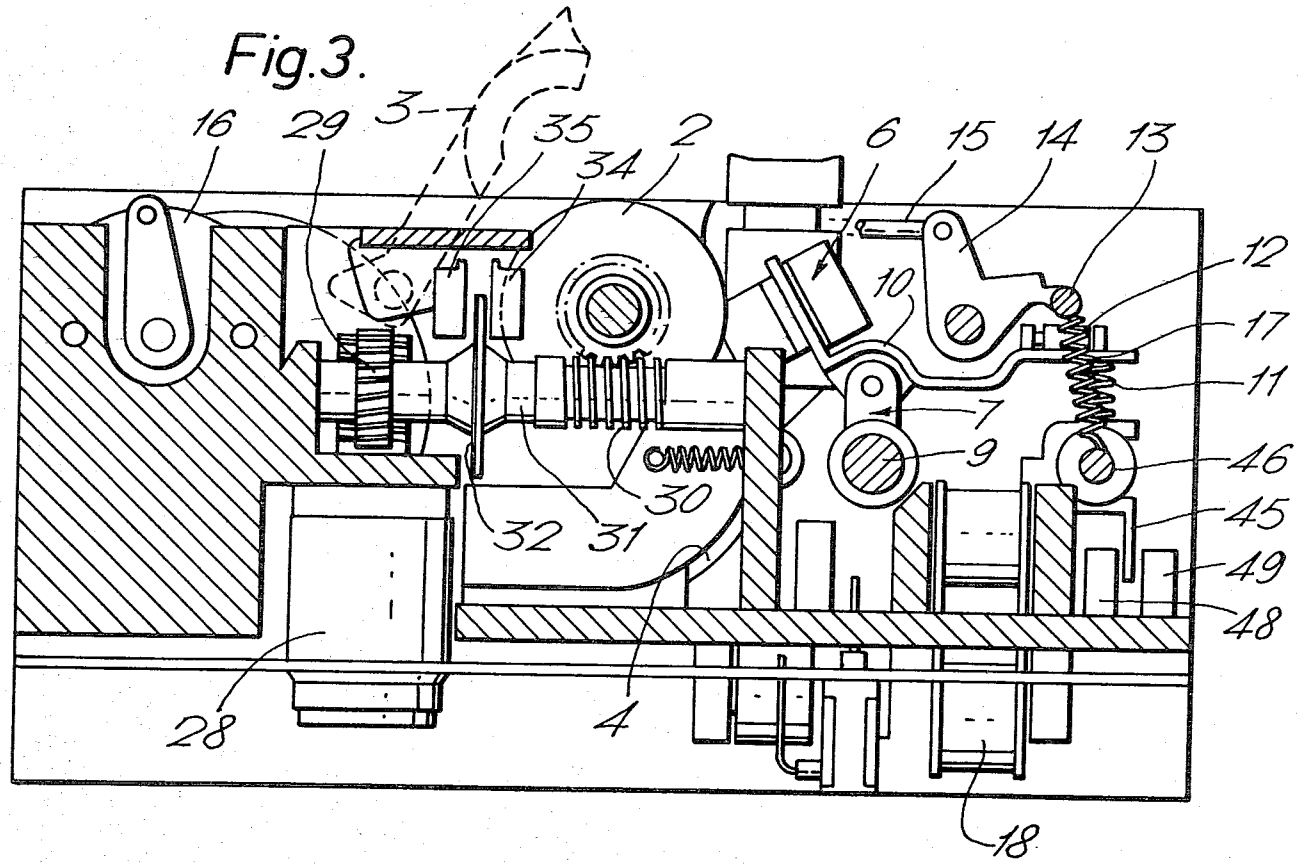
FIG. 3 is a side elevational view of the apparatus shown in FIGS. 1 and 2.

A further margin monitoring photocell 50 is adjustably located near the right hand end of the print head guide rod 9 as viewed in FIG. 1 and cooperates with a further light emitting diode 51 the light beam from which is interrupted by the flag 45 when the print head carriage reaches a limit position at the extreme right hand end of its travel.

A needle-cleaning brush pad 52 is arranged at the left-hand end of the path of movement of the print head 6 to engage and clean the working tips of the needles each time the head returns to the left-hand extreme position.

An electrical contact 53 is spring-loaded towards a conductive earthed roller 54 upstream of the paper guide 4 and is arranged to provide a paper out (POT) signal. When the paper depletion signal POT is provided there would typically be about 60 or 70 mm of paper left for printing, equivalent to 14 lines of alphanumeric characters.

What is claimed is:

1. An electro-mechanical printing apparatus including in combination a platen, means for advancing electro-sensitive paper over the platen, a print head cooperating with the platen, the print head having a number of selectively energizable needles arranged in a row in the print head, an electric motor, drive transmission means coupling the electric motor to the print head to effect translational movement of the latter parallel to the platen in a direction transverse the row of needles, a timing disc coupled to the drive transmission to be rotated thereby, the disc being subdivided into equi-angular sectors with adjacent sectors being of different light-transmitting or reflecting characteristics, photoelectric sensing means arranged to cooperate with the timing disc to produce periodic signals upon rotation of the disc, the photoelectric sensing means including two photocells displaced relative to each other around the timing disc so that the signals produced by the two photocells upon rotation of the disc are in phase quadrature relative to each other, and clock pulse generating means responsive to the periodic signals produced by the two photocells to provide a clock pulse each time a sector boundary passes either photocell, said clock pulses being utilized to control print needle energization and having a phase of generation relative to said periodic signals dependent on the direction of timing disc rotation and therefore on the direction of print head movement.

2. Apparatus as claimed in claim 1, including a carriage supporting the print head, means supporting the carriage for pivotal movement about an axis parallel to the platen and transverse the row of needles of the head, guide means for guiding movement of the carriage in a direction parallel to said axis, biassing means urging said carriage about said axis in a sense to move the print head away from the platen, and solenoid means acting when energised upon the carriage in opposition to the biassing means to maintain the needles of the print head in an operative printing position relative to the platen.

* * * * *